US006422054B1

(12) United States Patent
White

(10) Patent No.: US 6,422,054 B1
(45) Date of Patent: Jul. 23, 2002

(54) CONDUIT BENDING TOOL

(76) Inventor: William White, 10550 S. Hoyne, Chicago, IL (US) 60643

( * ) Notice: Subject to any disclaimer, the term of this patent is extended or adjusted under 35 U.S.C. 154(b) by 0 days.

(21) Appl. No.: 09/757,871

(22) Filed: Jan. 10, 2001

Related U.S. Application Data

(60) Provisional application No. 06/175,402, filed on Jan. 11, 2000.

(51) Int. Cl.[7] ..... B21D 7/02
(52) U.S. Cl. ..... 72/458; 72/459
(58) Field of Search ..... 72/458, 459, 460, 72/461

(56) References Cited

U.S. PATENT DOCUMENTS 2,847,705 A * 8/1958 Hellwig ..... 72/459
3,590,617 A 5/1968 Mount
3,718,018 A * 2/1973 Benfield ..... 72/458
3,906,778 A 9/1975 Crouse
4,052,881 A 10/1977 Mount
4,196,610 A 4/1980 Chilton
4,269,056 A * 5/1981 Kozinski ..... 72/459

* cited by examiner

*Primary Examiner*—David Jones
(74) *Attorney, Agent, or Firm*—Greer, Burns & Crain, Ltd.

(57) ABSTRACT

A bending block for use with a bending tool for bending pipe, conduit or the like of the type having a handle with a bending anvil at one end, the anvil having an arcuate edge about which pipe or the like may be bent comprises a block for attachment to the anvil arcuate edge. The bending block is movable along the edge, and may be locked in place. Using the bending block of the invention, bends of precise angles may be achieved. An improved bending tool of the type having a handle with a bending anvil at one end, the anvil having an arcuate edge, with the improvement comprising a bending block for movable attachment to the anvil arcuate edge.

15 Claims, 5 Drawing Sheets

CONDUIT BENDING TOOL

CROSS REFERENCE

The present application claims the priority of prior U.S. Provisional Application No. 60/175,402, filed Jan. 11, 2000.

FIELD OF THE INVENTION

The present invention relates to tools for bending pipe, conduit or the like. More particularly, the present invention relates to an improved pipe bending tool for achieving the correct desired angle of bend.

BACKGROUND OF THE INVENTION

Conduit bending tools generally comprise a handle having an arcuate bending anvil at an end. Conduit, pipe, or the like is bent as it is wrapped about an arcuate edge of the bending anvil. General, examples of such bending tools can be found in U.S. Pat. Nos. 4,196,610; 4,052,881; 3,906,778; and 3,590,617.

The bending tools of the prior art, however, have a heretofore unresolved problem. To achieve a desired degree of bend, conduit is partially wrapped around the arcuate anvil edge. The degree of bend achieved depends on the degree of wrap about the edge. Generally, pipe benders of the prior art rely on user judgment to indicate stop points during to achieve a desired degree of bend. Or, some tools may have visual markings along the anvil side indicating angles of bend. Relying on user judgment or on visual markings, however, offers only a limited accuracy of bend.

An improved conduit bending tool is therefore needed.

OBJECTS OF THE INVENTION

It is an object of the invention to provide an improved bending tool that provides for greater accuracy in achieving bends of a desired degree.

It is a further object of the invention to provide a bending block for use with a bending tool for accurate bending.

SUMMARY OF THE INVENTION

The present invention comprises an improved bending tool for bending pipe, conduit, or the like. The present invention further comprises a bending block for attachment to an existing bending tool.

The bending tool is of the type generally having a handle and a bending anvil attached to an end of the handle, the anvil having an arcuate edge. The tool is operable to bend pipe, conduit or the like when pipe is wrapped about the bending anvil arcuate edge. The improvement comprises a bending block movable along the bending anvil arcuate edge. The block has locking means for removably locking it in place at a desired position along the anvil edge, and has a stop generally in line to the anvil edge surface for receiving a pipe. A preferred stop comprises a concave surface. A preferred embodiment of the bending block further comprises opposing side arms for movably engaging the anvil sides. At least one of the side arms has locking means for releasably engaging the anvil.

The bending block of the invention is operable to be locked in place at a desired position along the anvil arcuate edge, with the block's stop for receiving the pipe or the like at a tangent to the anvil edge. As pipe or the like is wrapped around the anvil edge and thereby bent, the presence of the bending block prevents further bending. A precise angle of bend may thus be achieved.

The bending anvil may also have calibration marking along its edge side indicating degree of bend. A preferred bending block further comprises cooperating engaging means for releasably engaging the anvil calibration means. In a preferred embodiment, the anvil calibration means may comprise elongated ridges, while the block engaging means may comprise corresponding elongated slots for engaging the ridges.

The above brief description sets forth rather broadly the more important features of the present disclosure so that the detailed description that follows may be better understood, and so that the present contributions to the art may be better appreciated. There are, of course, additional features of the disclosure that will be described hereinafter which will form the subject matter of the claims appended hereto. In this respect, before explaining the several embodiments of the disclosure in detail, it is to be understood that the disclosure is not limited in its application to the details of the construction and the arrangements set forth in the following description or illustrated in the drawings. The present invention is capable of other embodiments and of being practiced and carried out in various ways, as will be appreciated by those skilled in the art. Also, it is to be understood that the phraseology and terminology employed herein are for description and not limitation.

DETAILED DESCRIPTION

Figure 1:
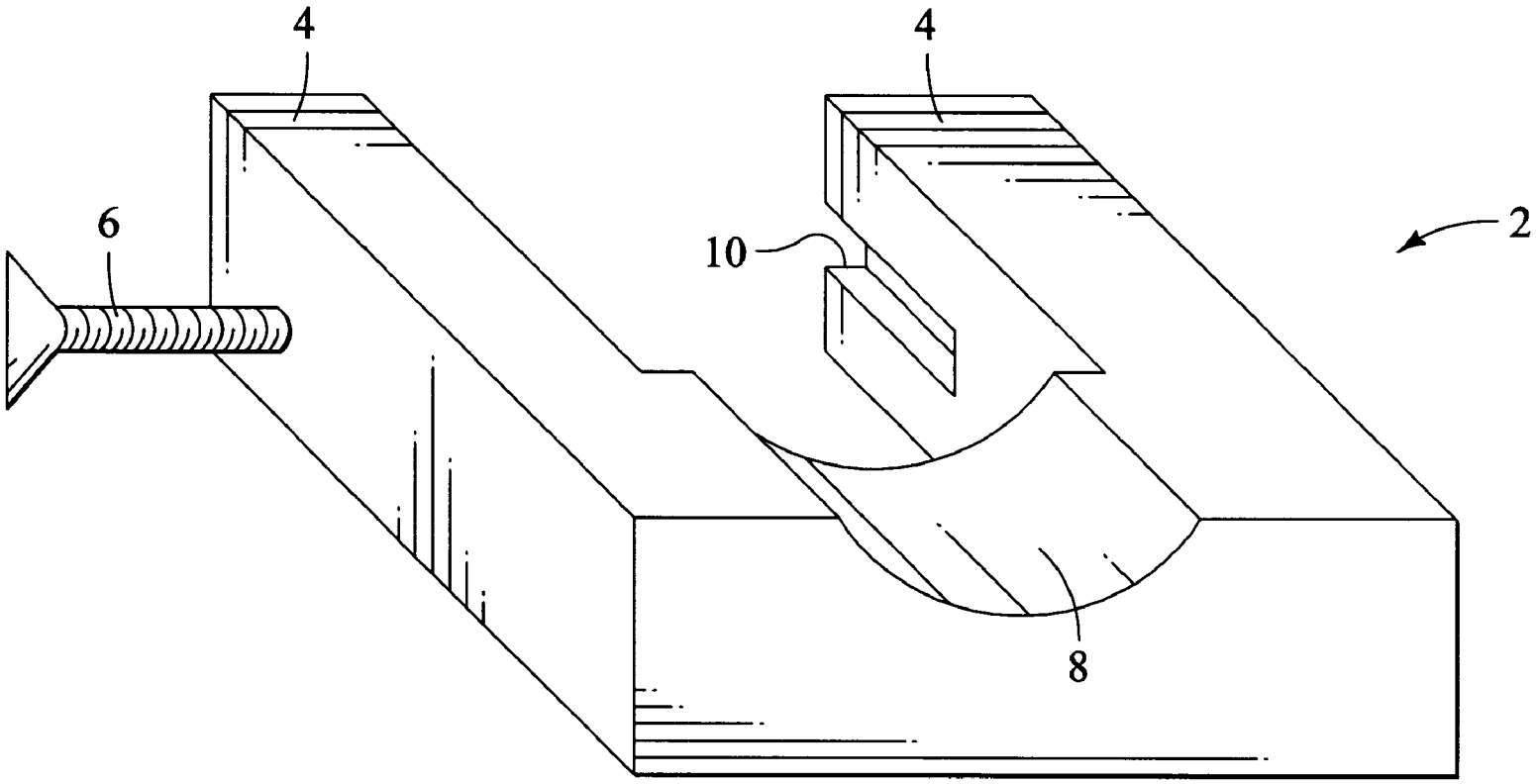
FIG. 1 is a perspective of a first embodiment of the invention.

Turning now to the drawings, FIG. 1 is a perspective view of a preferred embodiment of the invention, comprising a bending block 2 for use with a pipe bending tool of the type having a handle and a bending anvil with an arcuate edge. Bending block 2 comprises two opposing arms 4 for engaging sides of a bending anvil therebetween. One of the arm 4 has a lock bolt 6 for fixably engaging the side of the anvil to hold bending block 2 in place. Bending block 2 has concave surface 8 for receiving pipe or the like, and opposing slots 10 on respective arms 4.

Figure 2:
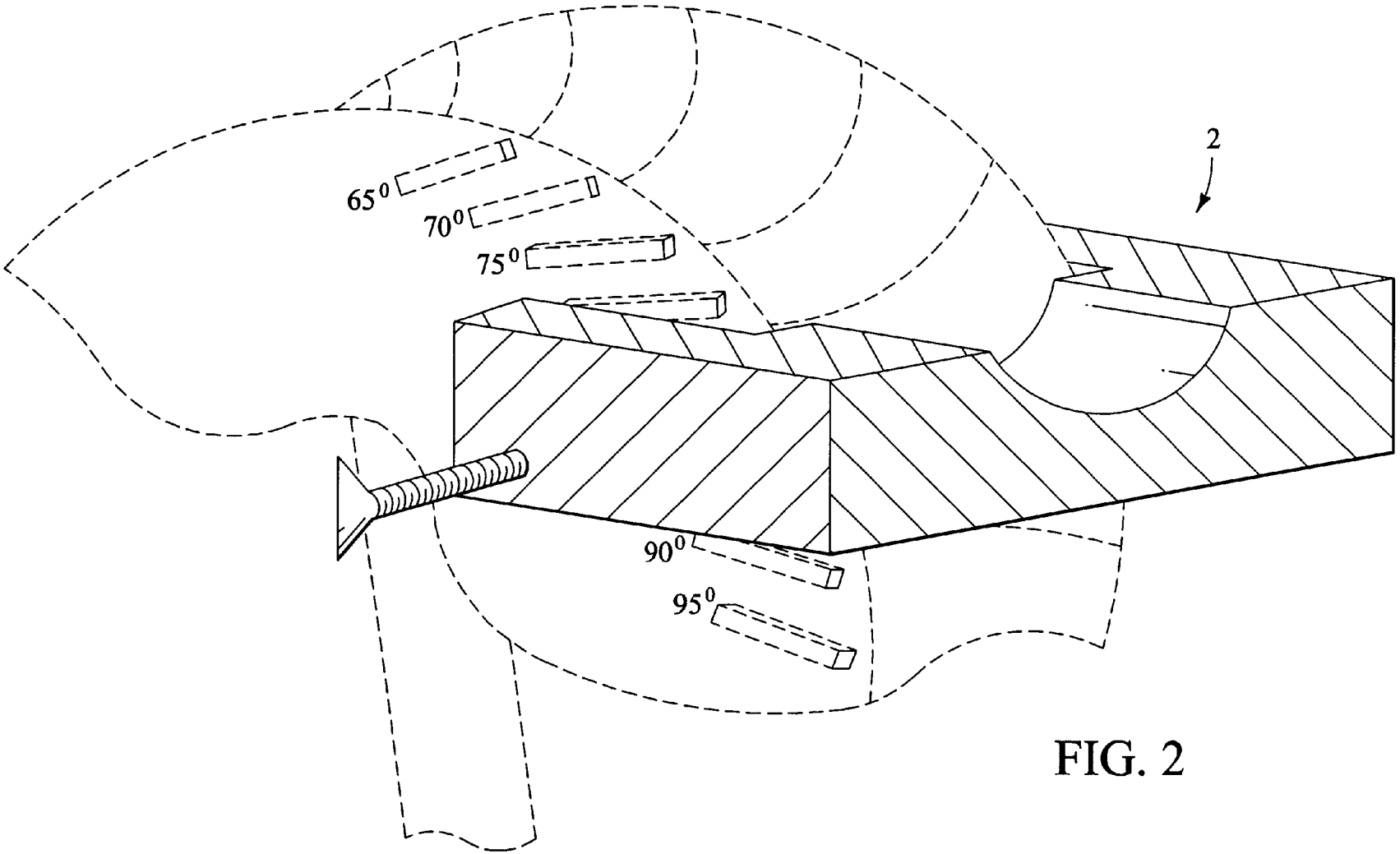
FIG. 2 is a perspective of the first embodiment of the invention engaged on a bending tool.

FIG. 2 shows the preferred embodiment of the bending block of the invention engaged on the arcuate edge of a bending anvil of a pipe bending tool. Bending block 2 may be moved along a bending anvil arcuate edge to a desired position. Once locked in place at the desired position, it is operable to receive pipe on its concave surface thereby preventing the pipe from bending further along the arcuate bending anvil edge.

A pipe bending tool may also have calibration means along the sides of the anvil arcuate bending edge corresponding to a measured degree. These means may comprise elongated ridges, as illustrated in FIG. 2. FIG. 1 shows bending block slots 10 for engaging such calibration ridges, so that block 2 may be fixably located along an anvil arcuate edge, as shown in FIG. 2. The markings may be placed such that when block 2 engages the markings it is located such that a desired angle of bend may be achieved with a great deal of accuracy.

If such calibration means on the anvil do not comprise ridges, but are instead simply markings, the bending block may comprise a curved base for movable mounting in the trough of the arcuate anvil. The curved base will have an arcuate shape approximately corresponding to the shape of the trough. The placement of the base in the trough will allow for the block to be supported and firmly held in place. The block can thus be moved along the anvil trough, and locked in place when located as desired and indicated by the calibration markings. Also, if the anvil does not have calibration ridges, the block will not require slots for receiving the ridges.

Figure 3:
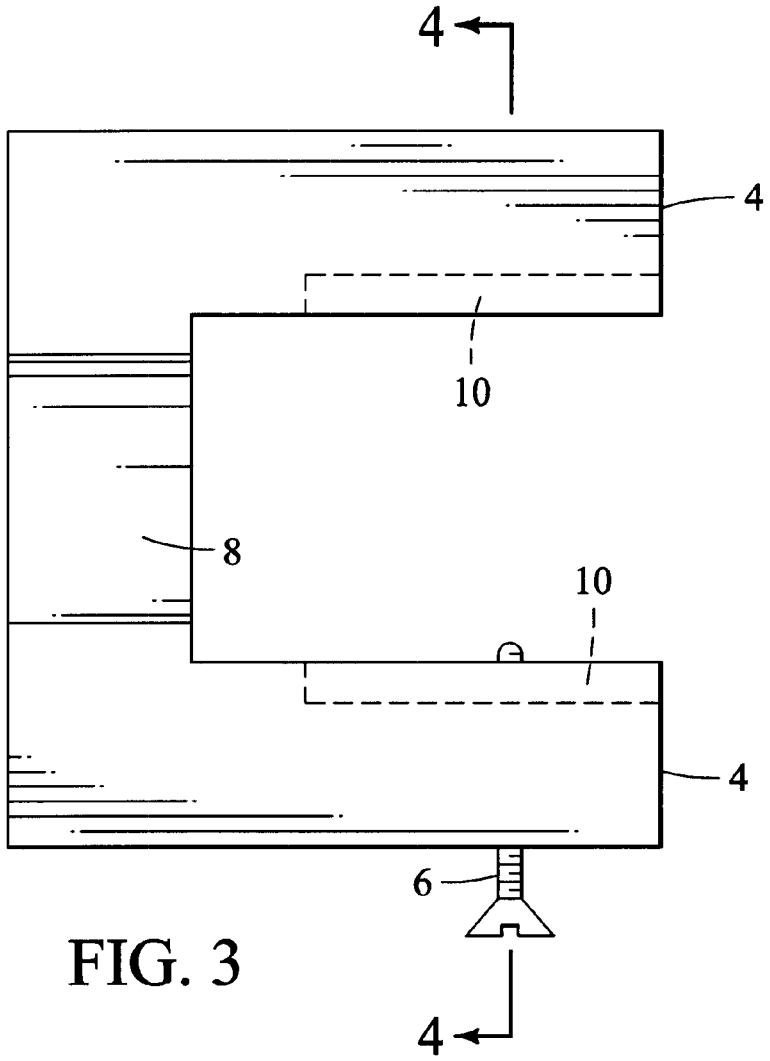
FIG. 3 is a plan view of the first embodiment of the invention.
Figure 4:
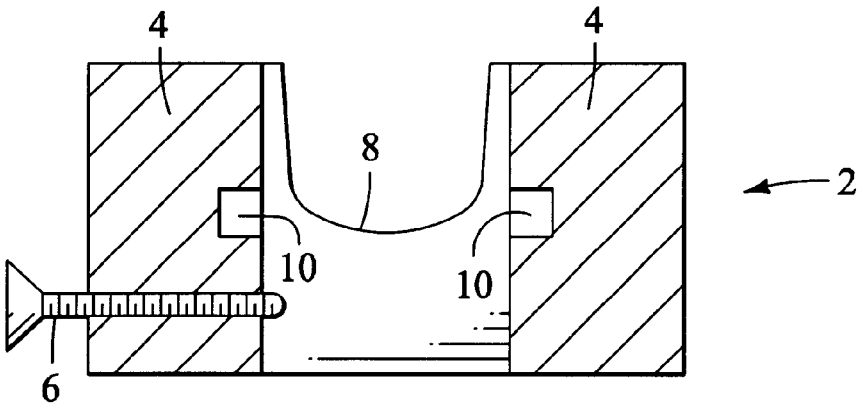
FIG. 4 is an end view of the first embodiment of the invention.

FIG. 3 is a plan view of the preferred bending block of the invention. It generally comprises opposing arms 4, lock bolt 6, concave surface 8, and slots 10 (shown in dashed line) for engaging calibration ridges. FIG. 4 is an end view of the preferred bending block of the invention, taken along the line 4—4 of FIG. 3. Bending block 2 generally comprises opposing arms 4, lock bolt 6, slots 10 for engaging calibration ridges, and concave surface 8.

Although a particular embodiment of the bending block of the invention has been described and illustrated, other embodiments are within the scope of the invention. For instance, the invention may comprise other calibration engaging means, such as movable pins for releasably engaging calibration divots or holes. Further, other means of locking the block in place may be comprised, including for example, but not limited to, a spring loaded lock pin.

Figure 5:
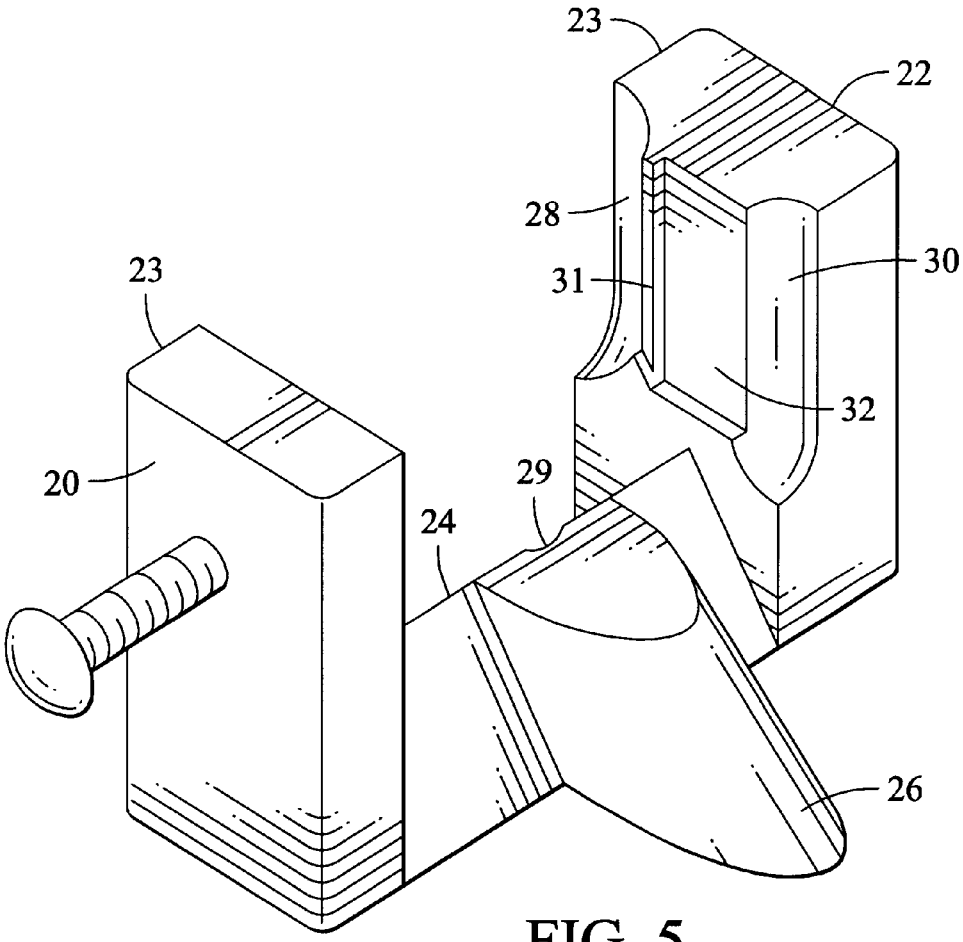
FIG. 5 is a perspective view of a second bending block embodiment.
Figure 6:
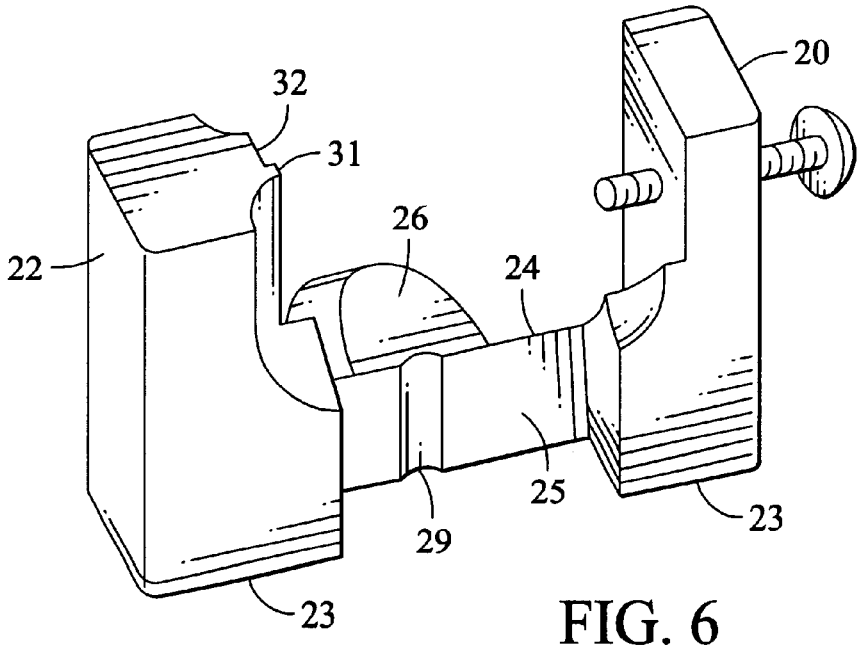
FIG. 6 is a perspective view of the second block embodiment.
Figure 7:
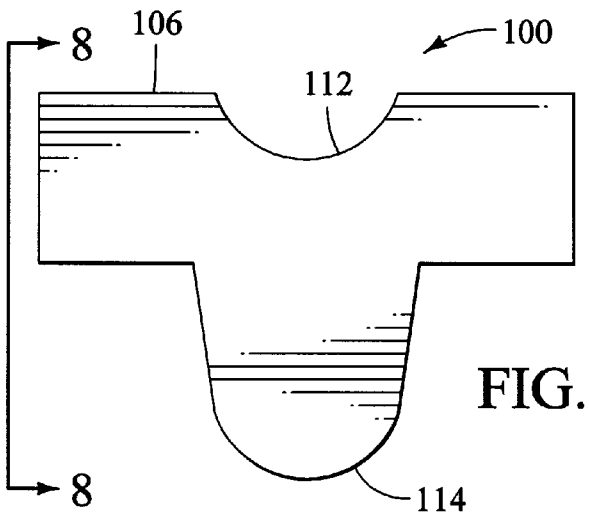
FIG. 7 is a rear elevational view of a third bending block embodiment.
Figure 8:
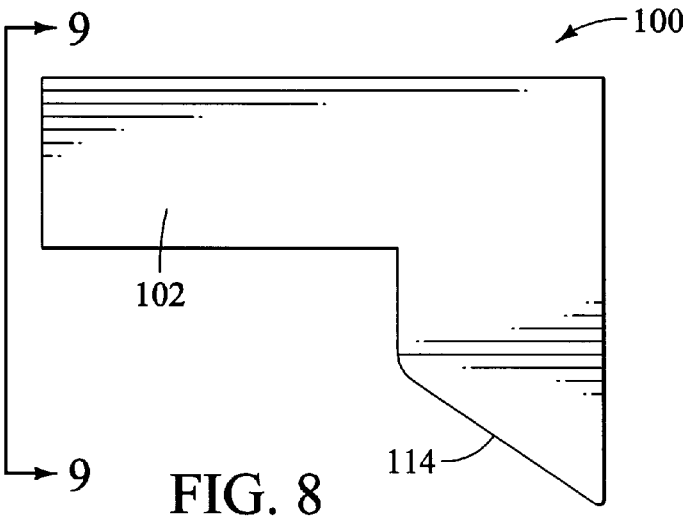
FIG. 8 is a side elevational view of the third block embodiment.
Figure 9:
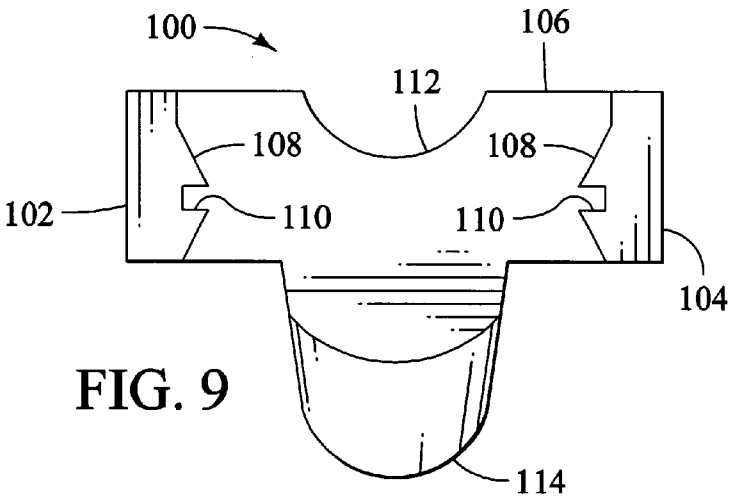
FIG. 9 is a front elevational of the third block embodiment.
Figure 10:
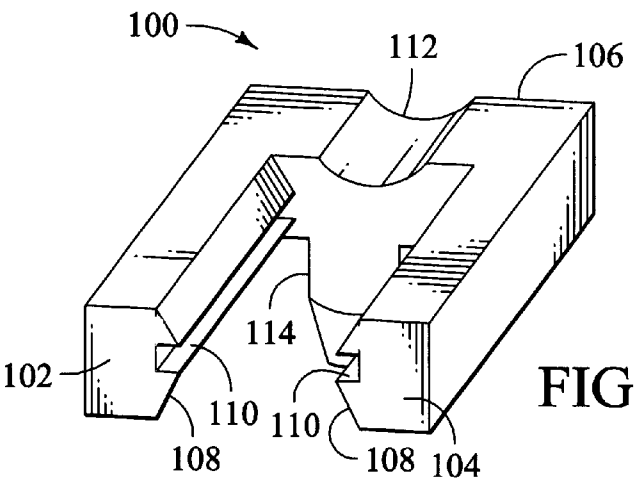
FIG. 10 is a perspective view of the third block embodiment.

FIGS. 5 and 6 are perspective views of an additional embodiment of the conduit bending tool of the invention. This embodiment comprises opposing arms 20 and 22 for engaging the opposing sides of the arcuate edges of the bending anvil as generally illustrated in FIG. 2. Opposing arms 20 and 22 are connected to one another by stop 24, which is substantially flat on an upper side 25. Stop upper side 25 preferably has a elongated concave receiving section 29 for receiving the conduit being bent. Upper side 25 is alos preferably located at a lower plane than side arm upper side 23 to prevent conduit from moving past side arms 20 and 22. An arcuate and sloped stop support 26 is attached to the bottom of stop 24 for reception in the bending anvil arcuate trough edge. Arcuate stop support 26 is sloped at an angle relative to the arms 20 and 22, and is preferably centered under concave receiving section 29. The arcuate and sloped shape of support 26 is configured for receiving in the bending anvil arcuate trough edge, so that stop 24 is well supported against loads at a variety of angles.

Arm 22 has inwardly rounded corners 28 and 30 for weight savings and for ease of installation and removal of the block. Side arm 22 has locking ridge 31 and shelf 32 for engaging a calibration ridge on the bending anvil. Arm 20 is thinner than arm 22, and will have its inner wall riding flat on top of calibration ridges. Arm 22 is also configured thicker than arm 20 for purposes of adding strength to the arm side that receives the anvil calibration ridges, and so that the block may be conveniently held with a hand for placement on the anvil. Finally, configuring arm 20 as thinner provides a weight advantage for the block.

Locking bolt 34 threadably passes through arm 20 for releasably engaging the side of the bending anvil and thereby holds the block in place.

FIGS. 7–10 illustrate still an additional embodiment of the bending block of the invention. Block 100 comprises two opposing side arms 102 and 104 and a stop 106 connecting the side arms. Side arms 102 and 104 have sloped inner edges 108, with elongated slots 110 for receiving a bending anvil calibration ridges. Stop 106 has a concave receiving section 112 for receiving the conduit. Stop 106 further has a sloped and arcuate underlying support 114 for being received in a bending anvil arcuate trough. Support 114 is sloped away from opposing side arms 102 and 104. It will be appreciated that this third bending block embodiment may further comprise a locking bolt on one opposing side arm 102 or 104 for holding the block in place.

The advantages of the disclosed invention are thus attained in an economical, practical, and facile manner. While preferred embodiments and example configurations have been shown and described, it is to be understood that various further modifications and additional configurations will be apparent to those skilled in the art. It is intended that the specific embodiments and configurations herein disclosed are illustrative of the preferred and best modes for practicing the invention, and should not be interpreted as limitations on the scope of the invention as defined by the appended claims.

What is claimed is:

1. A bending block for attachment to a bending tool for bending conduit, pipe, or the like; the bending tool of the type having a handle, a bending anvil with an arcuate edge at one end, the arcuate edge having a concave surface, the arcuate edge having calibration ridges on at least one side; the bending block movably attachable to the anvil arcuate edge, the block comprising:

a) a pair of opposing side arms for engaging the bending anvil edges; a first of said pair of opposing side arms having a ridge and a shelf for engaging an anvil calibration ridge; and b) a stop connecting said pair of opposing side arms; said stop for receiving the conduit; an arcuate support member connected to the bottom of said stop, said arcuate support member for engaging the anvil concave surface.

2. A bending block as in claim 1, wherein the second of said pair of opposing side arm thinner than the other of said opposing side arms.

3. A bending block as in claim 1, wherein said first opposing side arm having an inside edge with two inwardly rounded corners.

4. A bending block as in claim 1, wherein said stop having a concave receiving section for receiving the conduit.

5. A bending block for attachment to a bending tool for bending conduit, pipe, or the like; the bending tool of the type having a handle, a bending anvil with an arcuate edge at one end, the arcuate edge having a concave surface, the arcuate edge having calibration ridges on at least one side; the bending block movably attachable to the anvil arcuate edge, the block comprising:

a) a pair of opposing side arms for engaging the bending anvil edges; a first of said pair of opposing side arms having a pair of inwardly rounded corners; said first opposing side arm thicker than the other of said pair of opposing side arms; said first opposing side arm having a shelf and a ridge for engaging the bending anvil calibration ridge; said opposing side arms having a top side;

b) a stop connecting said pair of opposing side arms; an arcuate support member connected to the bottom of said stop, said arcuate support member for engaging the anvil concave surface, a concave receiving section on said stop for receiving the conduit; said stop having an upper side located at a lower plan than said side arm upper sides; and c) a locking bolt threadably received through said second side arm for releasably engaging the bending anvil side edge.

6. A bending block for attachment to a bending tool for bending conduit, pipe, or the like; the bending tool of the type having a handle, a bending anvil with an arcuate edge at one end, the arcuate edge having a concave surface, the arcuate edge having calibration ridges on at least one side; the bending block movably attachable to the anvil arcuate edge, the block comprising:

a) a pair of opposing side arms, said side arms having sloped inner edges with an elongated slot, said side arms for engaging the arcuate edge, said elongated slot for receiving the calibration ridge; and b) a stop connecting said opposing side arms; said stop having an underlying support for engaging the bending anvil arcuate edge, said underlying support arcuate and sloped away from said side arms; said stop having a top side, a concave receiving section in said stop top side for receiving the conduit.

7. A bending block as in claim 6, wherein said block further comprises a locking bolt threadably passing through one of said opposing side arms for releasably engaging the bending anvil side edge and thereby holding the bending block in place.

8. An improved bending tool for bending conduit, pipe, or the like, of the type having a handle, a bending anvil with an arcuate edge at one end, the arcuate edge having a concave surface, having opposing sides with calibration markings comprising elongated ridges along both sides, the improvement comprising:

a bending block, said block movable along the arcuate edge, said block having a pair of opposing arms for engaging the arcuate edge sides therebetweeen, a lock bolt on at least one of said block arms for locking said block at a location on the edge, said block having a stop for receiving the pipe, conduit, or the like, and an elongated slot in each of said block arms for engaging the elongated calibration ridges.

9. An improved bending tool as in claim 8 wherein said stop comprises a concave surface.

10. An improved bending tool as in claim 8 wherein the block arcuate edge and sides define an arcuate cross section, and wherein said bending block further comprises:

a support member connected to the bottom of said stop for engaging the anvil arcuate edge, said support member having an arcuate shape adapted to cooperate with the block arcuate cross section.

11. A bending block for attachment to a bending tool for bending conduit, pipe, or the like of the type having a handle, a bending anvil with an arcuate edge at one end, the arcuate edge having a concave surface, having opposing sides with calibration markings comprising elongated ridges along both sides, the block comprising:

a pair of opposing arms for engaging the arcuate edge sides therebetween, at least one of said arms having a locking bolt for locking the block in position on the anvil arcuate edge, each of said arms having an elongated slot for engaging the elongated calibration ridges; and, a stop connected to said arms for receiving the conduit, pipe or the like.

12. A bending block as in claim 11 wherein said stop comprises a concave surface.

13. A bending block as in claim 11 wherein the block arcuate edge and sides define an arcuate cross section, and wherein the block further comprises:

a support member connected to the bottom of said stop for engaging the anvil arcuate edge, said support member having an arcuate shape adapted to cooperate with the block arcuate cross section.

14. A bending block for attachment to a bending tool for bending conduit, pipe, or the like of the type having a handle, a bending anvil with an arcuate edge at one end, the arcuate edge having a concave surface, having opposing sides with calibration markings comprising an elongated ridge along at least one side, the block comprising:

a pair of opposing arms for engaging the arcuate edge sides therebetween, at least one of said arms having a locking bolt for locking the block in position on the anvil arcuate edge, at least one of said arms having an elongated slot for engaging the elongated calibration ridges; and, a stop connected to said arms for receiving the conduit, pipe or the like.

15. A bending block as in claim 14 wherein the block arcuate edge and sides define an arcuate cross section, and wherein the block further comprises:

a support member connected to the bottom of said stop for engaging the anvil arcuate edge, said support member having an arcuate shape adapted to cooperate with the block arcuate cross section; and wherein said stop comprises a concave surface.

* * * * *